US006761347B2

(12) United States Patent
Moore

(10) Patent No.: US 6,761,347 B2
(45) Date of Patent: Jul. 13, 2004

(54) SHAPED ICE ARTICLE AND ARTICLE FOR MAKING SAME

(76) Inventor: Pamela R. Moore, 123 Cleveland Ave., Mogadore, OH (US) 44260

( * ) Notice: Subject to any disclaimer, the term of this patent is extended or adjusted under 35 U.S.C. 154(b) by 0 days.

(21) Appl. No.: 09/906,340

(22) Filed: Jul. 16, 2001

(65) Prior Publication Data

US 2002/0040958 A1 Apr. 11, 2002

Related U.S. Application Data

(63) Continuation of application No. 09/225,906, filed on Jan. 5, 1999, now Pat. No. 6,345,802, which is a continuation-in-part of application No. 09/089,283, filed on Jun. 2, 1998, now abandoned.

(51) Int. Cl.[7] ..... F25C 1/24
(52) U.S. Cl. ..... 249/117; 249/119; 249/121
(58) Field of Search ..... 249/119, 120, 249/121, 136, 160, 117

(56) References Cited

U.S. PATENT DOCUMENTS

| | | | | |
|---|---|---|---|---|
| 26,429 | A | 12/1859 | Halvorson | |
| 139,858 | A | 8/1873 | Blackman | |
| 298,694 | A | 5/1884 | Jewett | |
| 1,688,888 | A | 10/1928 | Spreen | |
| 1,831,047 | A | 11/1931 | Thomas | |
| 1,953,167 | A | 4/1934 | Geyer | 62/108.5 |
| 2,083,081 | A | 6/1937 | Moll | 62/108.5 |
| 2,132,879 | A | 10/1938 | Pownall | 62/108.5 |
| 2,136,425 | A | 11/1938 | Fields | 18/39 |
| 2,166,560 | A | 7/1939 | Schmelzer | 62/108.5 |
| 2,247,018 | A | 6/1941 | Henning | 62/108.5 |
| 2,247,019 | A | 6/1941 | Henning | 62/108.5 |
| 2,291,672 | A | 8/1942 | Youngberg | 31/42 |
| 2,411,193 | A | 11/1946 | Cummins | 62/108.5 |
| 2,434,803 | A | 1/1948 | Johnson et al. | 62/108.5 |
| 2,594,127 | A | 4/1952 | Collier | 62/108.5 |
| 2,704,928 | A | 3/1955 | Curry | 62/108.5 |
| 2,796,742 | A | 6/1957 | Platt | 62/108.5 |
| 3,025,682 | A | 3/1962 | Kniffin | 62/340 |
| 3,113,672 | A | 12/1963 | Brown | 206/63.2 |
| D202,529 | S | 10/1965 | Rosebrook | D67/3 |
| 3,214,128 | A | 10/1965 | Beck et al. | 249/66 |
| 3,340,798 | A | 9/1967 | Winger | 100/219 |
| 3,565,389 | A | 2/1971 | Price | 248/121 |
| 3,799,493 | A | 3/1974 | Beck et al. | 249/104 |
| D244,131 | S | 4/1977 | Lalonde | D15/90 |
| D244,275 | S | 5/1977 | Gurbin | D15/90 |
| D245,008 | S | 7/1977 | LaLonde | D15/90 |
| 4,148,457 | A | 4/1979 | Gurbin | 249/130 |
| 4,162,780 | A | 7/1979 | Rankin | 249/127 |
| 4,417,716 | A | 11/1983 | Penna et al. | 249/121 |
| D271,709 | S | 12/1983 | Snow, Jr. | D15/90 |
| D281,696 | S | 12/1985 | Barnhart | D15/90 |
| D287,856 | S | 1/1987 | Stewart | D15/90 |
| D292,802 | S | 11/1987 | Fails | D15/90 |
| 4,804,083 | A | 2/1989 | Weeks | 206/216 |
| 4,843,836 | A | 7/1989 | Childers | 62/293 |

(List continued on next page.)

OTHER PUBLICATIONS

Article entitled "VeloNews", the Journal of Competitive Cycling.

*Primary Examiner*—James P. Mackey
(74) *Attorney, Agent, or Firm*—Hahn, Loeser & Parks LLC

(57) ABSTRACT

An article for forming a freezable substance includes a body having at least one cavity. The cavity has an open top, an open bottom and side walls therebetween. The top has a maximum width Wm, with Wm being less than or equal to 0.875 inches (22.23 mm). The width Wm is chosen so that a long, cylindrical ice cube is formed by the cavity. The ice cube so formed fits easily into original containers of beverages, such as soda cans and bottles, so that the beverages are cooled in their original containers.

1 Claim, 6 Drawing Sheets

U.S. PATENT DOCUMENTS

| | | | | |
|---|---|---|---|---|
| 4,883,251 | A | 11/1989 | Manas | 249/53 |
| D307,997 | S | 5/1990 | Bernstein | D7/616 |
| D309,905 | S | 8/1990 | Weissman | D15/90 |
| 4,981,022 | A | 1/1991 | Snyder | 62/457.3 |
| D318,281 | S | 7/1991 | McKinlay | D15/90 |
| 5,129,238 | A | 7/1992 | Schwartz et al. | 62/457.3 |
| 5,188,744 | A | 2/1993 | Silverman | 249/121 |
| 5,201,194 | A | 4/1993 | Flynn, Jr. et al. | 62/457.3 |
| 5,235,823 | A | 8/1993 | Coker | 62/530 |
| 5,250,315 | A | 10/1993 | Loew et al. | 426/524 |
| 5,357,761 | A | 10/1994 | Schauer | 62/56 |
| D352,045 | S | 11/1994 | Daenen et al. | D15/90 |
| 5,397,097 | A | 3/1995 | Dale | 249/121 |
| 5,456,090 | A | 10/1995 | McCoy | 62/372 |
| 5,467,877 | A | 11/1995 | Smith | 215/11.1 |
| 5,502,981 | A | 4/1996 | Sullivan | 62/372 |
| 5,507,156 | A | 4/1996 | Redmon | 62/400 |
| 5,590,542 | A | 1/1997 | Wang | 62/457.3 |
| 5,597,087 | A | 1/1997 | Vinarsky | 220/482 |
| 5,609,039 | A | 3/1997 | Green et al. | 62/475.3 |
| 5,806,338 | A | 9/1998 | Schwartz et al. | 62/530 |
| 5,971,352 | A | 10/1999 | Kirks | 249/117 |
| 6,345,802 | B2 * | 2/2002 | Moore | 249/119 |

* cited by examiner

SHAPED ICE ARTICLE AND ARTICLE FOR MAKING SAME

This application is a Continuation of Application Serial No. 09/225,906 filed on Jan. 5, 1999, now U.S. Pat. No. 6,345,802, which is a Continuation-In-Part of application Ser. No. 09/089,283, filed on Jun. 2, 1998, now abandoned.

BACKGROUND OF THE INVENTION

This invention pertains to methods and apparatuses for chilling beverages, and more specifically to methods and apparatuses for freezing substances into useful forms such that the freezable substances, once frozen, have an elongated, narrow form such that they are insertable into a beverage container, beverage can, juice can, water bottle, sports bottle or the like and can more effectively cool the entire depth of the beverage.

DESCRIPTION OF THE RELATED ART

Basic "cube-shaped" ice "cubes" and ice cube trays are known in the prior art. Typically, ice cube trays are designed to produce ice cubes having a cubic or rectangular form. The prior art also teaches ice cube trays which produce ice cubes having a variety of forms. For example, in U.S. Pat. No. 4,417,716 an ice tray is disclosed which forms completely enclosed chambers of different shaped ice. Further, in Des. 287,856 another shaped ice cube tray is disclosed. Other designs are disclosed in U.S. Des. Pat. Nos. D244,275; D292,802; and D318,281.

Notwithstanding the fact that the prior art teaches both ice cubes having a variety of forms and the ice cube trays for making these ice cubes, the prior art does not teach a frozen substance or a method of freezing a substance such that the freezable substance, once frozen, has an elongated form such that the frozen substance is insertable into a beverage container, beverage can, juice can, water bottle, sports bottle or the like and resultingly more effectively cools the entire depth of the beverage.

For example, a conventional beverage can has a depth of about 5.0 inches (127 mm) and has an opening with a width of about 0.75 inches (19.05 mm). Beverage containers such as water, soda or beverage bottles have various depths ranging from about 11.0 inches (279.4 mm) for a typical polyester two liter bottle to about 6.0 inches (152.4 mm) for a typical bottled water bottle. These containers also have openings of various widths. Neither the conventional cubic or rectangular ice cubes, nor the various forms of ice cubes that the prior art teaches, are insertable within these containers because of the narrowness of the containers' openings. Consequently these beverages can not be easily cooled in their containers by the addition of ice cubes or other frozen substances. The only way to cool these beverages while they are in their containers is to place them into a cool environment such as a refrigerator, freezer, ice box, ice bucket, cooler, tub of ice, or the like. However, the introduction of a beverage container into a very cold environment can lead to a messy result as the beverage container may rupture as the freezable substance within the container expands during freezing.

Furthermore, when a straw is used to consume a beverage, the use of conventional ice cubes in the beverage does not achieve the advantages offered by the current invention. It is common knowledge that when ice is added to a beverage, the ice floats. Consequently, the upper, rather than the lower, portion of the beverage is cooled. When a straw is used to consume the beverage, the non-cooled lower portion of the beverage is sucked up through the straw and introduced into the consumer's mouth rather than the cooled upper portion of the beverage wherein the ice cubes reside. This is dissatisfying and contrary to the motives behind adding ice cubes to beverage containers; namely, consuming a cool beverage. The current invention solves this problem. The elongated form of the current invention assures that the frozen substance is narrow and insertable into a beverage container, beverage can, juice can, water bottle, sports bottle or the like and that the lower portion of the beverage, from which the beverage is consumed when the consumer uses a straw, is cooled.

SUMMARY OF THE INVENTION

According to one aspect of the invention, a body is provided which has at least one elongated cavity within it. The cavity has a top, a bottom and sidewalls between the top and bottom. The freezable substance is placed into the cavity through the top or bottom. The top and/or bottom have a maximum width, Wm, which is less than or equal to 0.875 inches (22.23 mm).

According to another aspect of the invention, a body is provided which has at least one elongated cavity within it. The cavity has a top, a bottom and sidewalls between the top and bottom. The freezable substance is placed into the cavity through the top or bottom. The top and/or bottom have a maximum width, Wm, which is less than or equal to 1.1875 inches (30.1625 mm).

According to another aspect of the invention the top and/or bottom have a maximum width, Wm, which is less than or equal to 0.625 inches (15.875 mm).

According to another aspect of the invention the cavity has a depth, X. The depth X of the cavity is measured from the top of the cavity to the bottom of the cavity, or vice versa. The depth X is greater than or equal to 1.5 inches (38.1 mm).

According to another aspect of the invention the top may be circular, having a diameter Dt. The bottom may also be circular, having a diameter Db, where Db is less than or equal to Dt.

According to another aspect of the invention the width of the cavity is less than or equal to 0.875 inches (22.23 mm) at any point along its depth.

According to another aspect of the invention the width of the cavity is less than or equal to 0.625 inches (15.875 mm) at any point along its depth.

According to another aspect of the invention the width of the cavity at any point along its depth is less than or equal to the width of the top of the cavity. Additionally, the width of the cavity at any point along its depth is greater than or equal to the width of the bottom of the cavity.

According to another aspect of the invention the article has a sealing means for selectively sealing the top or bottom so that the freezable substance cannot spill out of the cavity prior to becoming frozen. The means for sealing the opening can take the configuration of a lid, "zip-loc" mechanism, screw-in mechanism, frictionally fastening means or any other like means which would prevent spillage of the freezable substance prior to its freezing.

According to another aspect of the invention, a body is provided which has at least one elongated cavity within it. The cavity has a top and bottom, and sidewalls between the top and bottom. The freezable substance is placed into the cavity through either the top or bottom. The top and/or bottom have a maximum width, Wm, which is less than or equal to 0.875 inches (22.23 mm). The body also has sealing means for selectively sealing the top and/or the bottom, so that the freezable substance is not spillable from the cavity prior to the freezable substance becoming frozen.

According to yet another aspect of the invention, a tray for freezing water to form ice cubes is disclosed using a plurality of body's having one cavity within said body, cavity having an top and bottom, and side walls therebetween. The tray also comprises sealing means for the body's to selectively sealing the top and/or the bottom, so that the freezable substance is not spillable from the cavity prior to the freezable substance becoming frozen. Further, the tray has attachment means to attach the plurality of body's to one whereby the plurality of body's are integral and form the tray.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
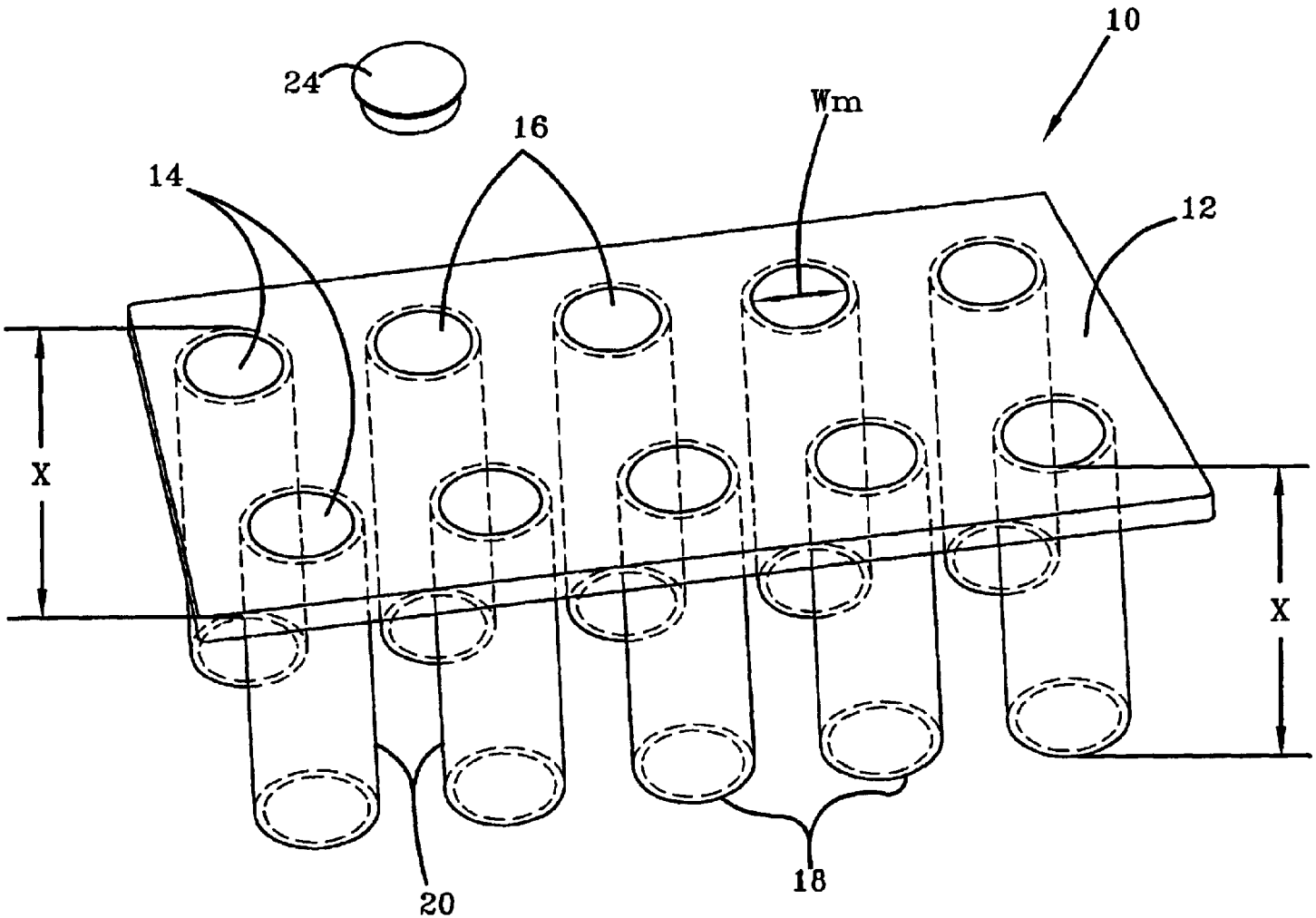
FIG. 1 is a perspective view of one embodiment of the invention having more than one cavity.
Figure 2:
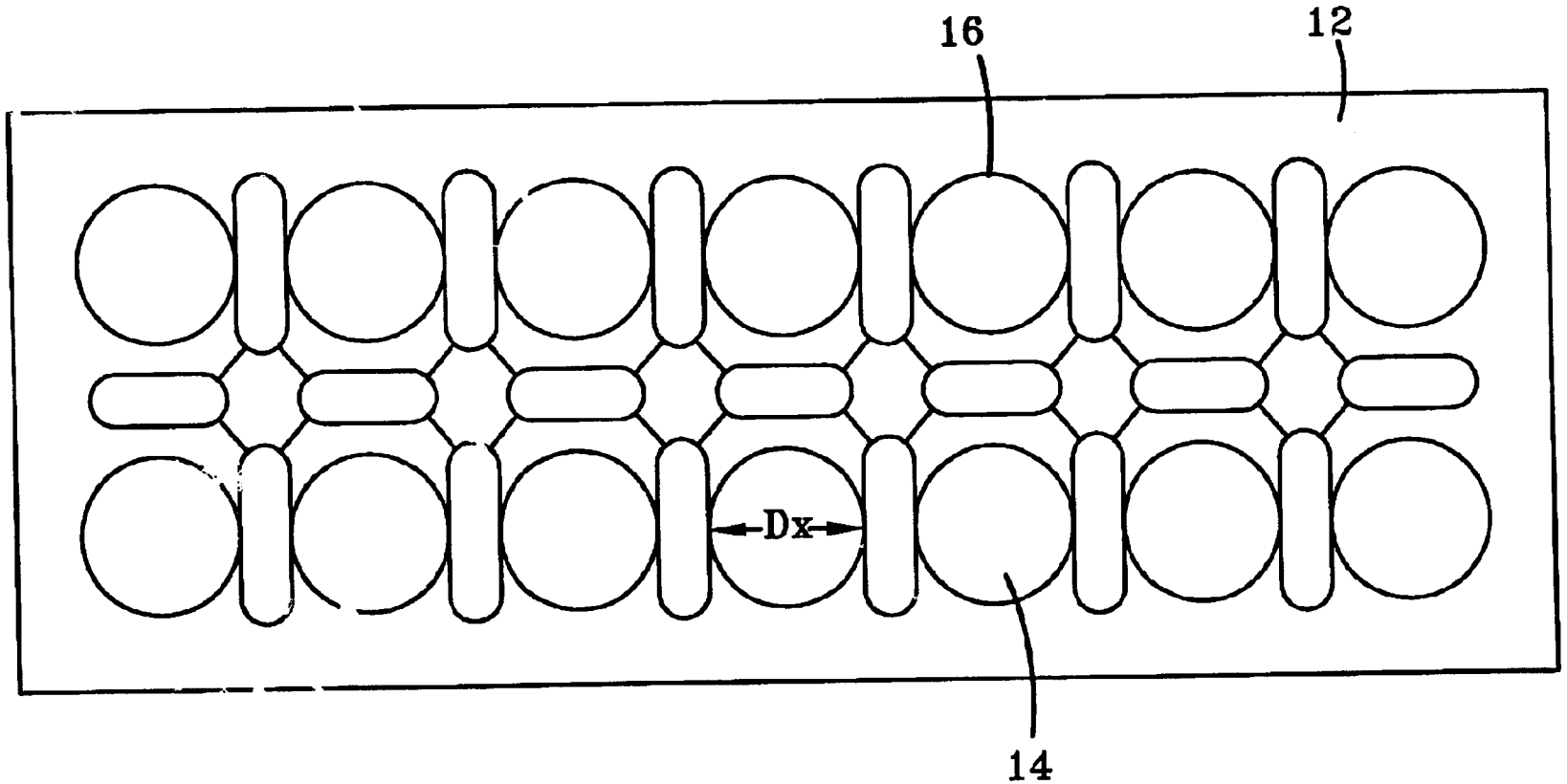
FIG. 2 is a top view of one embodiment of the invention having more than one cavity.
Figure 3:
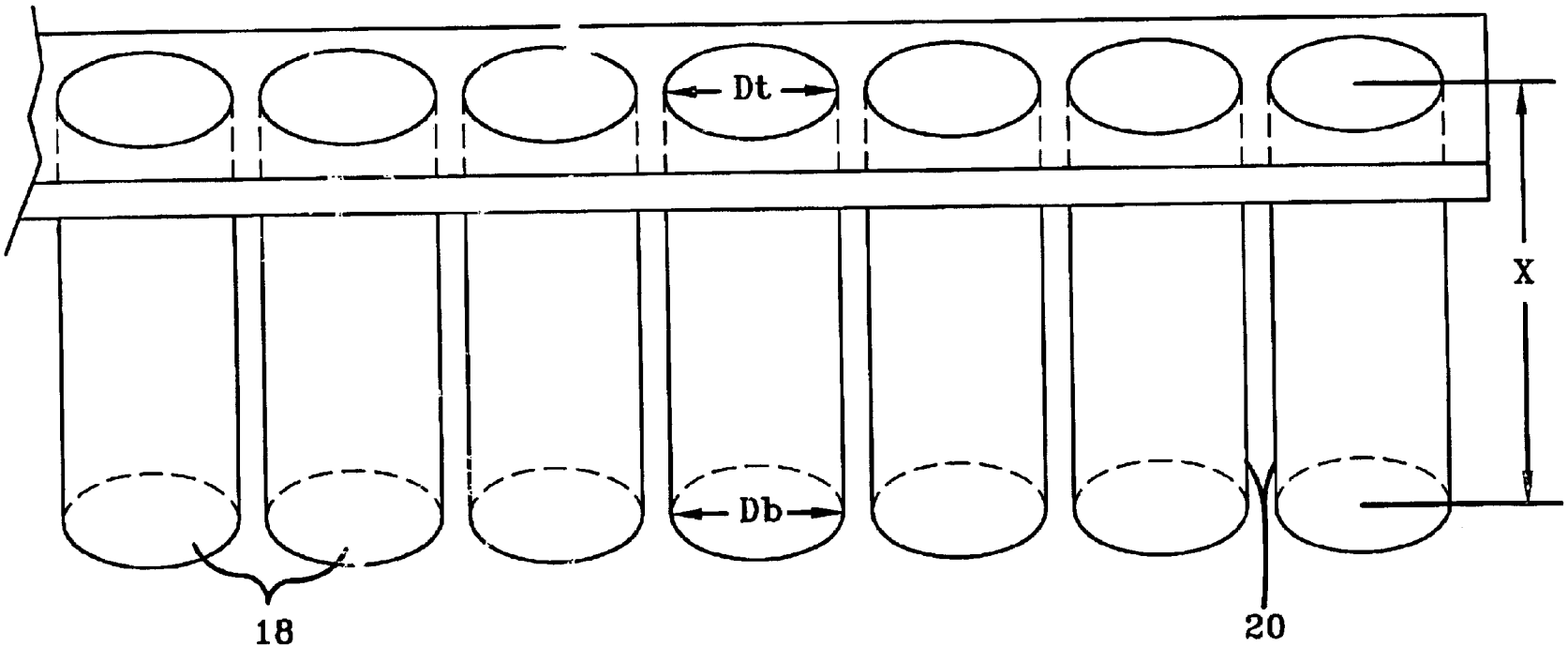
FIG. 3 is a side view of one embodiment of the invention having more than one cavity.

Referring now to the drawings wherein the showings are for purposes of illustrating a preferred embodiment of the invention only and not for purposes of limiting the same, FIGS. 1, 2 and 3 show the preferred embodiment of the invention. Throughout this specification, the term "ice cube" and "ice cube tray" will be used for convenience of the reader, even though the shape and form of the ice formed by the inventive structure may not be cubic. In addition, while the invention will be referred to in the context of freezing water to form ice, any freezable substance is within the scope of the invention.

In the preferred embodiment, a body 12 of an article 10 contains multiple cavities 14. Each cavity 14 has an open top 16 and open bottom 18 and side walls 20 between the top 16 and bottom 18. The top 16 and/or bottom 18 of each cavity 14 has a maximum width Wm of less than or equal to 0.625 inches (15.875 mm). Each cavity 14 has a depth X of greater than or equal to 1.5 inches (38.1 mm). The depth X is measured from the top 16 to the bottom 18, as shown in the FIG. 1.

The maximum width Wm is important, as the primary goal of the invention is to cool drinks within their respective containers. Because most of the drink containers presently have interior diameters less than 0.625 inches (15.875 mm), the present invention provides a way to effectively cool the beverage within its original container. Further, because the ice cube is now "narrow", and because cooling is a function of surface area, the length of the ice cube is necessarily lengthened in order to provide the requisite level of cooling. Therefore, in an ice cube formed by the inventive article, the depth X is greater than a conventional ice cube. Also because of the greater surface area afforded, the preferred form of the cavity is one that will provide a generally cylindrical shaped ice cube. However, it is within the scope of this invention to have ice cubes having shapes not generally cylindrical.

Figure 4:
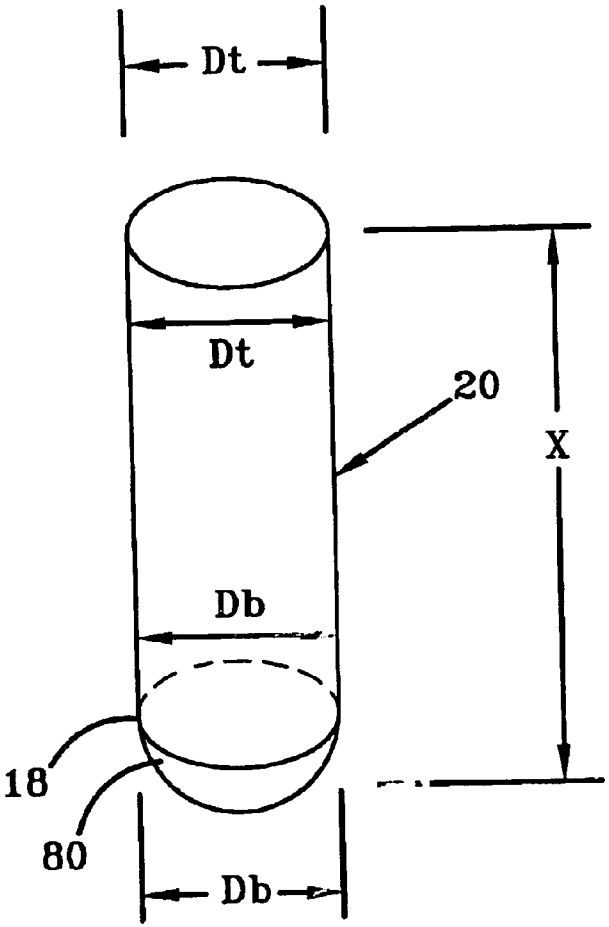
FIG. 4 is a side view of a cavity.

FIG. 4 shows a side view of a cavity 14 wherein the freezable substance is formed as it freezes. The top 16 may be circular having a diameter Dt. The bottom 18 may be circular having a diameter Db.

In addition to the foregoing, FIG. 1 also shows another embodiment wherein a sealing means 24 is used to prevent the freezable substance from spilling out of the cavity 14 prior to freezing. The sealing means 24 may comprise any type of sealing that does not allow the freezable substance from exiting the cavity 14 prior to its freezing. Typically, the sealing means comprises a cap 25 that may be attached to the body 12. The sealing means may also be a screw-type of arrangement whereby the sealing means comprises a threaded attachment to either the top 16 or bottom 18 of the body 12.

In addition to the foregoing another embodiment is contemplated wherein the maximum width Wm of the top 16 and/or bottom 18 is less than or equal to 0.625 inches (15.875 mm).

In addition to the foregoing another embodiment is contemplated wherein the cavity has a width less than or equal to 0.875 inches (22.23 mm) at any point along its depth, which is typically less than soda bottles. However, for drinks typically having a wider cavity or "mouth", the width is less than or equal to 1.1875 inches (30.1625 mm). These containers are typically found on wider "mouth" sport and/or soda bottles.

In addition to the foregoing another embodiment is contemplated wherein the cavity has a width less than or equal to 0.625 inches (15.875 mm) at any point along its depth.

Figure 5:
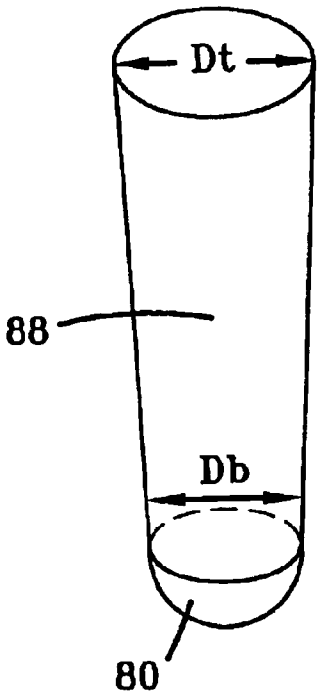
FIG. 5 is a side view of an ice structure (or ice cube) formed from a cavity.

In addition to the foregoing, with reference to FIG. 5, another embodiment is illustrated wherein the diameter of the bottom Db is less than or equal to the diameter of the top Dt.

In addition to the foregoing, with continued reference to FIG. 5, another embodiment is contemplated wherein the width of the cavity at any point along its depth is less than or equal to the width of the top and greater than or equal to the width of the bottom. Also shown in FIGS. 4 and 5 is another preferred embodiment in which the bottom 18 has a rounded, somewhat spherical surface 80. It is believed the rounded surface 80 will ease the removal of the ice cube or ice structure 88.

Figure 6:
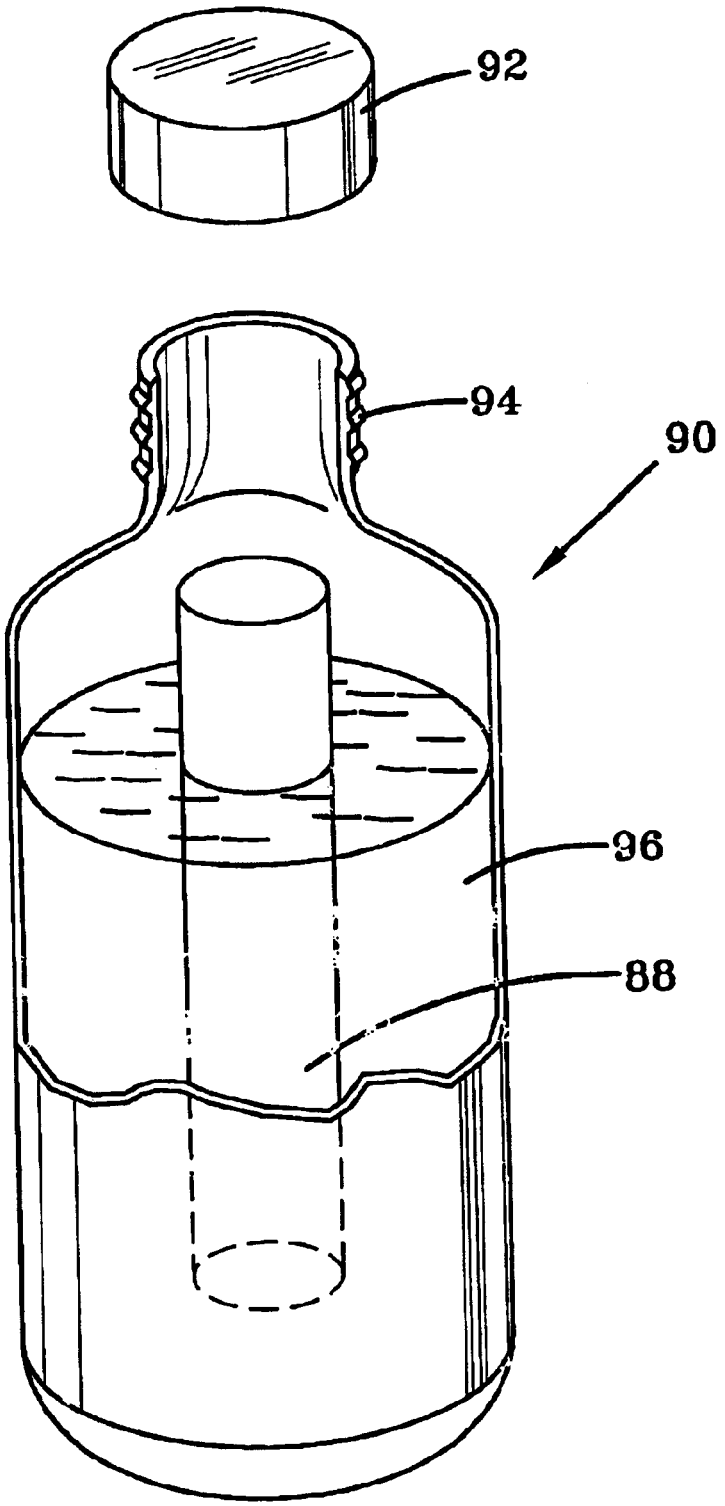
FIG. 6 is a side view, in partial cross-section, of an associated beverage container with the inventive chilling article installed inside, and, FIG. 7 is a perspective view of a tray for freezing water to form ice cubes.

With reference to FIG. 6, the method of chilling a beverage within its original container will now be described. In a typical beverage container 90, the lid 92 is removed, typically by unscrewing the lid 92 from the container 90 via threads 94, depending upon the beverage used. The frozen ice structure 88 is then inserted into the container 90 so that the longitudinal centerline of the structure 88 is coaxial with the longitudinal centerline of the beverage container 90. The entire depth of the beverage 96 becomes cooled and chilled by the article 88.

Figure 7:
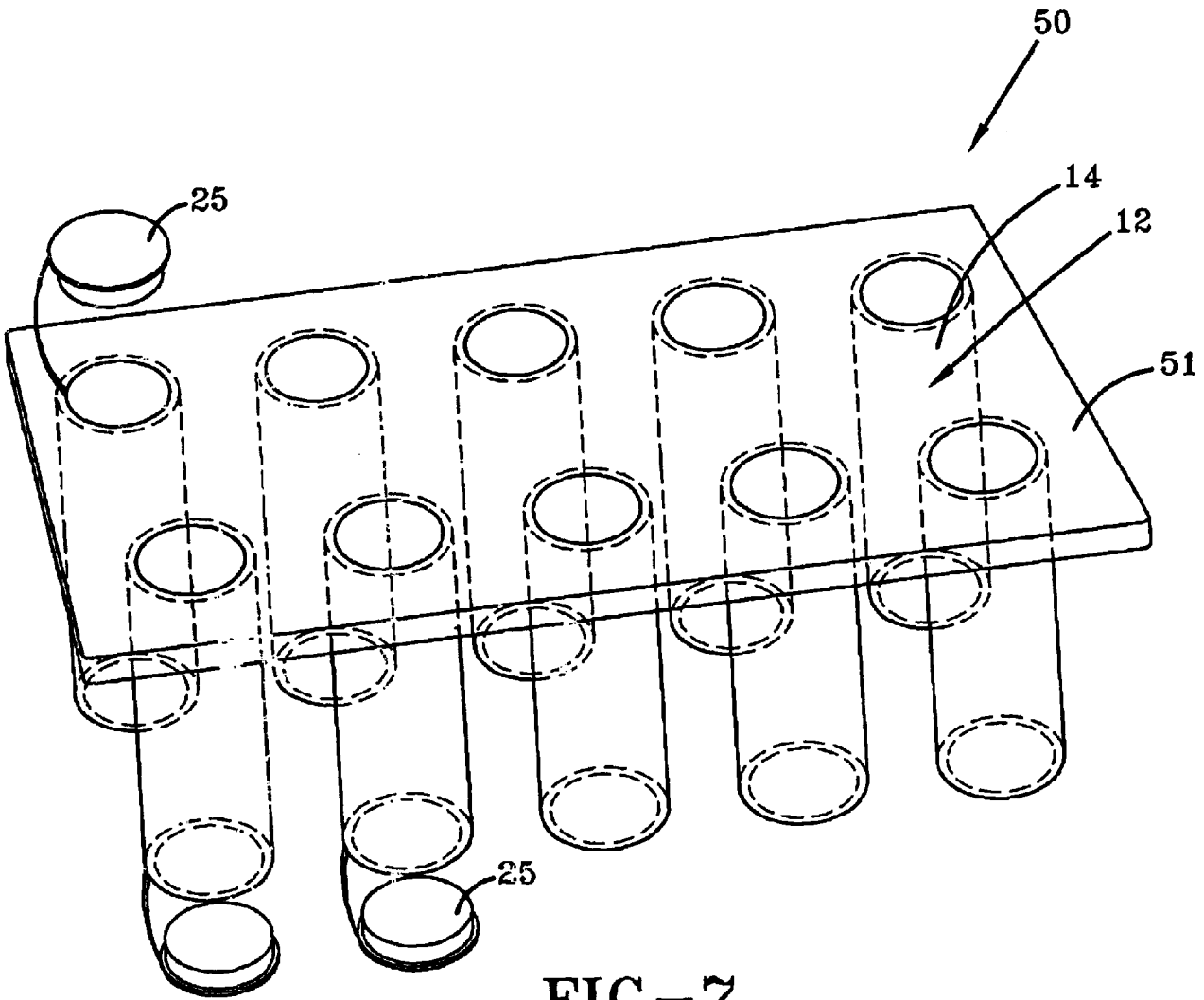

With reference to FIG. 7, a tray 50 for freezing water to form the ice cubes mentioned hereinabove is shown. The tray comprises a plurality of body's 12 having one cavity 14 within the body 12. The tray also has the sealing means for selectively sealing the top and/or the bottom, so that the freezable substance is not spillable from the cavity 14 prior to the freezable substance becoming frozen. The tray 50 also has attachment means 51 to attach the plurality of body's 12 to one another thus making the body's 12 are integral with one another and forming the tray 50.

As pictured in both FIG. 1 and FIG. 7 the cavities may be arranged in a plurality of rows or columns to achieve an optimal maximization of space for any given scenario.

The preferred embodiments have been described. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed.

What is claimed is:

1. An ice tray for forming freezable rods of ice, comprising:

at least one rigid circular body having one cavity integrally formed within said body, said cavity having a completely open top and completely open bottom and side walls therebetween, said top and bottom having a maximum width Wm, said cavity having a constant diameter, said open top allowing for the insertion of a freezable substance;

sealing means for said bottom and said top of said cavity, whereby said sealing means is removable in order to facilitate the removal of the freezable substance from said bottom of said cavity, said sealing means of said top and bottom of said cavity being of equal size and equal shape, said sealing means individually sealing said at least one rigid circular body.

* * * * *